US007631846B2

(12) United States Patent
Arnold et al.

(10) Patent No.: US 7,631,846 B2
(45) Date of Patent: Dec. 15, 2009

(54) PIEZOELECTRIC IGNITER MOUNTING BRACKETS

(75) Inventors: J. Eric Arnold, Jonesborough, TN (US); Roger D. Veen, Johnson City, TN (US)

(73) Assignee: American Water Heater Company, Johnson City, TN (US)

( * ) Notice: Subject to any disclaimer, the term of this patent is extended or adjusted under 35 U.S.C. 154(b) by 0 days.

(21) Appl. No.: 11/890,975

(22) Filed: Aug. 8, 2007

(65) Prior Publication Data

US 2009/0039223 A1 Feb. 12, 2009

(51) Int. Cl.
*A47K 1/08* (2006.01)

(52) U.S. Cl. ..... 248/311.2; 248/300; 248/312.2

(58) Field of Classification Search ..... 248/311.2, 248/311.3, 312, 312.1, 304, 305, 313, 300; 122/14.1

See application file for complete search history.

(56) References Cited

U.S. PATENT DOCUMENTS 3,656,624 A * 4/1972 Walton ..... 210/242.3
5,257,765 A * 11/1993 Halle ..... 248/222.13
5,395,081 A * 3/1995 Vollink ..... 248/218.4
5,711,503 A * 1/1998 Mitchell, Sr. ..... 248/311.2
6,164,347 A * 12/2000 Dahlmann ..... 141/370
6,666,421 B2 12/2003 Hueser
6,691,959 B1 * 2/2004 Dancy ..... 248/100
2002/0179794 A1 * 12/2002 Yang ..... 248/311.2
2007/0210228 A1 * 9/2007 Brenner et al. ..... 248/311.2
2008/0087233 A1 4/2008 Waller et al.

OTHER PUBLICATIONS

Drawing of a Bracket : The attached drawing sheet illustrates a bracket that was sold by the assignee of this application and that Applicants admit is prior art to this application.

* cited by examiner

*Primary Examiner*—Amy J. Sterling
(74) *Attorney, Agent, or Firm*—Michael Best & Friedrich LLP

(57) ABSTRACT

An igniter bracket for a gas control valve comprising a base member sized and shaped to be mounted adjacent at least a portion of a first surface of the gas control valve; an igniter holder extending from the base member in a direction away from the gas control valve and having an opening to receive an igniter; at least one positioning arm extending from the base member in a direction substantially opposite of the igniter holder and adapted to engage at least a portion of a second surface of the gas control valve or a body extending from a second surface; and at least one clamp member extending from the base member in a direction substantially opposite of the igniter holder and adapted to engage at least a portion of a third surface of the gas control valve or a body extending from the third surface.

23 Claims, 4 Drawing Sheets

PIEZOELECTRIC IGNITER MOUNTING BRACKETS

TECHNICAL FIELD

This disclosure relates to piezoelectric igniter mounting brackets, particularly to mounting brackets adapted to be attached to gas control valves of water heaters.

BACKGROUND

It is desirable in manufacturing gas water heaters to connect a Piezoelectric igniting device to the gas control valves. Such a connection allows the piezo igniter to be firmly connected to a solid portion of the water heater so that it can be activated safely and easily. Such a connection can also create an externally conductive path that provides grounding on the associated clip.

One configuration may be found in U.S. Pat. No. 6,666,421 wherein a piezo igniter is mounted in a bracket on the top of a gas control valve. However, the construction of that bracket is directed to a particular construction/brand of gas control valve and is accordingly inapplicable to other gas control valves.

FIG. 1 shows another conventional gas control valve 10. A piezo igniter 12 is mounted to gas control valve 10 by bracket 14. Bracket 14 is mounted to an upper portion of the side of gas control valve 10 and is attached on one side by a pair of U-shaped arms (not shown) and a stud 15 that engages a depression 17 in the front face 16 of gas control valve 10. Bracket 14 effectively mounts igniter 12 to gas control valve because of a tab 18 that engages the top surface 20 of gas control valve 10 such that application of downward force as indicated by the arrow A on the operative button 22 of igniter 12 maintains bracket 14 in the desired position at the upper side of gas control valve 10.

However, that arrangement is limited to the specific construction of gas control valve 10 and is, therefore, inapplicable to other available gas control valves.

SUMMARY

We provide an ignitor bracket for a gas control valve comprising: a base member sized and shaped to be mounted adjacent at least a portion of a first surface of the gas control valve; an igniter holder extending from the base member in a direction away from the gas control valve and having an opening to receive an igniter; at least one positioning arm extending from the base member in a direction substantially opposite of the igniter holder and adapted to engage a body extending from a second surface of the gas control valve; and at least one clamp member extending from the base member in a direction substantially opposite of the igniter holder and adapted to engage at least a portion of a third surface of the gas control valve or a body member extending from the third surface.

We further provide an igniter bracket for a gas control valve comprising a base member sized and shaped to be mounted adjacent at least a portion of a first surface of the gas control valve; an igniter holder extending from the base member in a direction away from the gas control valve and having an opening to receive an igniter; at least one positioning arm extending from the base member in a direction substantially opposite of the igniter holder and adapted to engage at least a portion of a second surface of the gas control valve or a body extending from the second surface; and at least one clamp member extending from the base member in a direction substantially opposite of the igniter holder and adapted to engage at least a portion of a third surface of the gas control valve or a body member extending from the third surface; and a stabilizer arm extending from the base member in a direction substantially opposite of the igniter holder and adapted to engage at least a portion of a bottom portion of the gas control valve.

DETAILED DESCRIPTION

Figure 1:
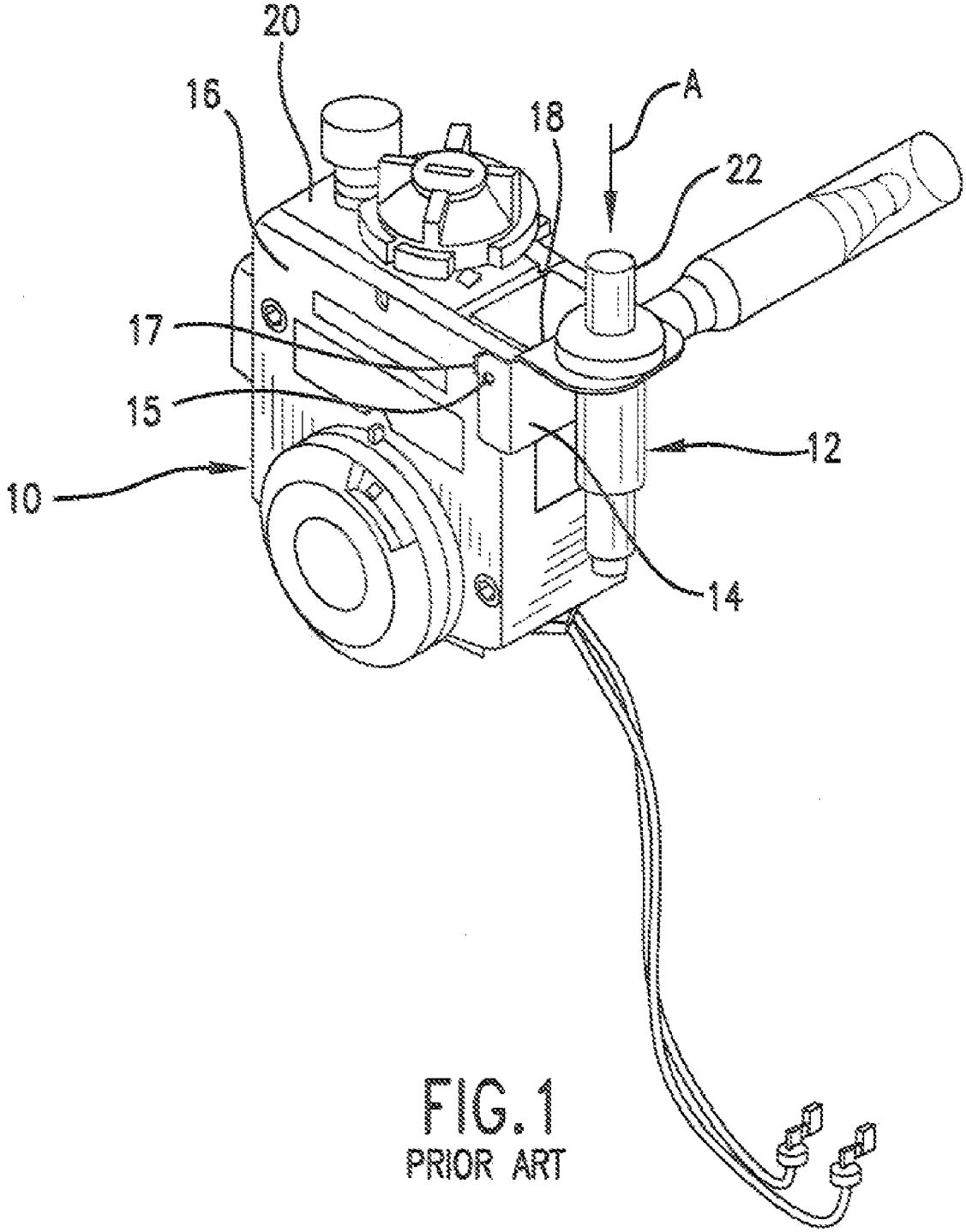
FIG. 1 PRIOR ART
FIG. 1 is a perspective view of a conventional igniter bracket attached to a water heater gas control valve.
Figure 2:
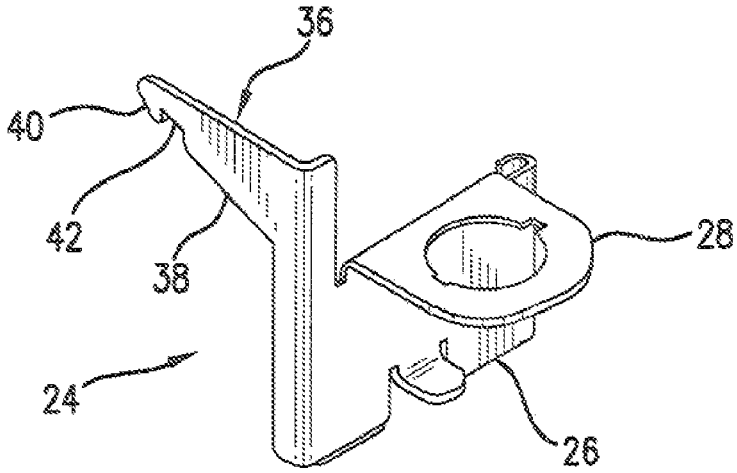
FIG. 2 is a perspective view of our bracket.
Figure 3:
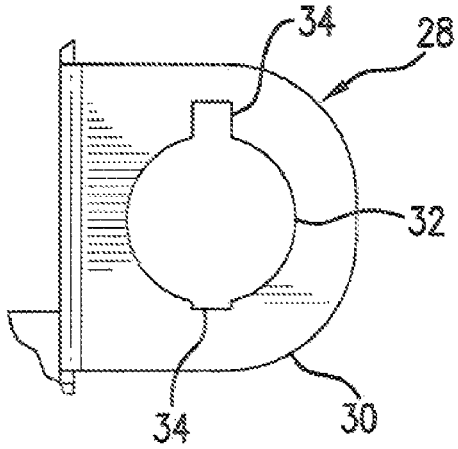
FIG. 3 is a partial top plan view of the bracket of FIG. 2.

It will be appreciated that the following description is intended to refer to specific structure selected for illustration in the drawings and is not intended to define or limit that structure or this disclosure, other than in the appended claims.

Figure 9:
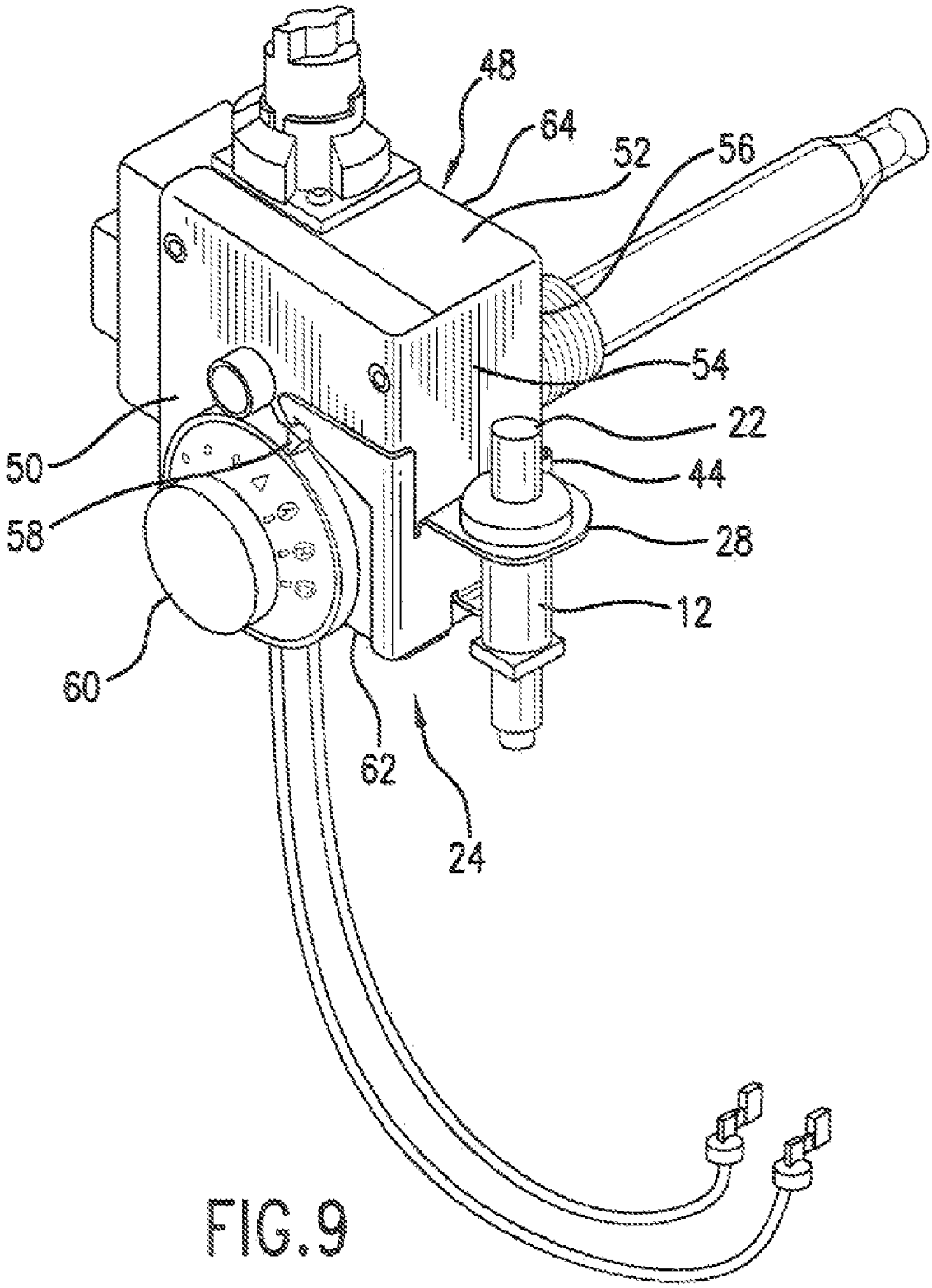
FIG. 9 is a perspective view of the bracket of FIG. 2 affixed to a gas control valve.

Turning now to FIGS. 2-9, we provide an igniter bracket 24 that is applicable to at least the gas control valve shown in FIG. 9. Referring now to FIG. 9, it can be seen that bracket 24 is mounted onto a gas control valve 48. The gas control valve 48 has a front surface 50, a top surface 52, a side surface 54 and a bottom surface 62. Base member 26 of bracket 24 lies substantially flat against side surface 54 of gas control valve 48.

Bracket 24 includes a base member 26 which is substantially flat and adapted to engage a side surface of a gas control valve 48. Bracket 24 also includes an igniter holder 28. As particularly shown in FIG. 3, igniter holder 28 is substantially a tab 30 with rounded edges and has a central opening 32 which is sized and shaped to receive an igniter 12 of the type shown in FIG. 1. There are also a pair of slots 34 in opening 32 that are sized and shaped to receive "snap action" arms to removably fix igniter 12 into a selected position. Igniter holder 28 extends substantially perpendicularly away from base member 26 and extends away from the side of gas control valve 48 when mounted into a selected position.

Bracket 24 includes at least one positioning arm 36 which extends substantially perpendicularly from base member 26 in a direction substantially opposite of the igniter holder 28. Positioning arm 36 is adapted to engage at least a portion of the front surface 50 of gas control valve 48 and/or a body extending from that front surface 50. Positioning arm 36 includes an elongated extended and tapered neck 38 and has a jaw member 40 at its distal end. The jaw member 40 includes a slot 42 sized and shaped to engage a body extending from the front surface of the gas control valve.

Figure 4:
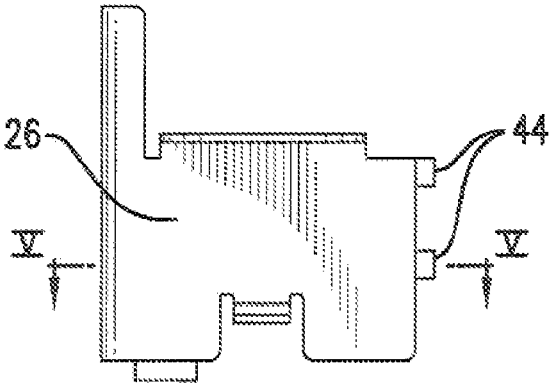
FIG. 4 is a front elevational view of the bracket of FIG. 2.
Figure 5:
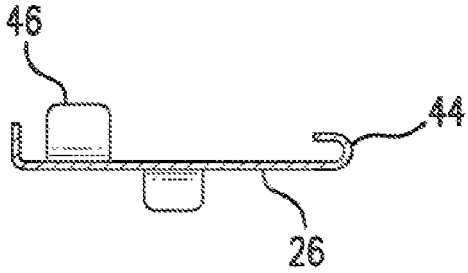
FIG. 5 is a sectional view taken along the lines and arrows V-V of FIG. 4.
Figure 6:
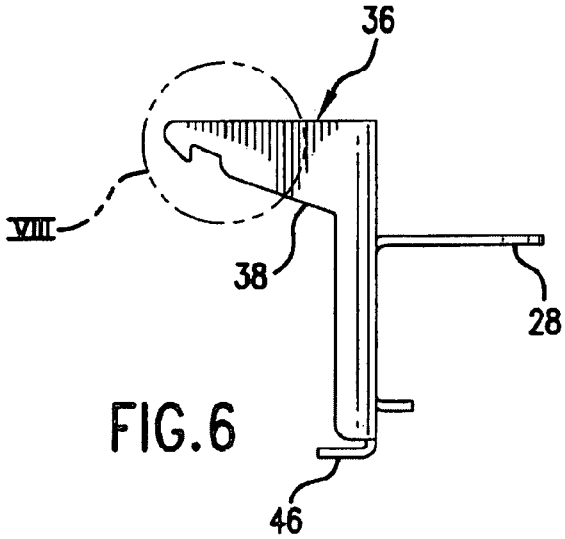
FIG. 6 is a side elevational view of the bracket of FIG. 2.
Figure 7:
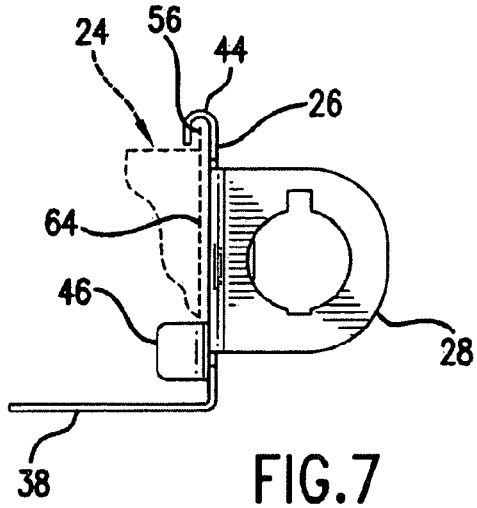
FIG. 7 is a top plan view of the bracket of FIG. 2 mounted on a gas control valve, a portion of which is shown in phantom.
Figure 8:
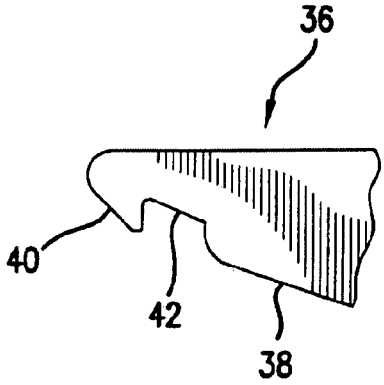
FIG. 8 is an exploded view taken from the phantom circle of FIG. 6.

As shown in FIGS. 4, 5 and 7 in particular, base member 26 has a clamp member extending in a direction substantially opposite of the igniter holder and is adapted to engage at least a portion of the rear surface of the gas control valve or a body member extending from that rear surface. The clamp member may particularly be a pair of U-shaped clamp arms 44. The U-shaped clamp arms engage a rib 56 on the rear surface 64 of the gas control valve.

Bracket 24 also comprises a stabilizer arm 46 which extends substantially perpendicularly to base member 26 and in a direction substantially opposite of the igniter holder 28. Stabilizer arm 46 is adapted to engage at least a portion of the bottom surface 62 of the gas control valve 48. Stabilizer arm 46 may be a tab having rounded edges, for example.

Igniter 12 is positioned in igniter holder 28 in a selected fixed position. Clamp member 44 engages an edge 56 formed between side surface 54 and a rear surface 64 of gas control valve 48.

On the other hand, positioning arm 38 extends along front surface 50 of control valve 48 and jaw member 40 engages an outwardly protruding member such as dial positioning arrow 58. Dial positioning arrow 58 is positioned to allow a user to adjust gas control valve dial 60 to a selected position to control the water heater burner (not shown). Other protruding members of various shapes and sizes may be used.

Slot 42 of jaw member 40 is sized and shaped to engage positioning arrow 58 such that positioning the arm is "locked" into a selected position. Other sizes and shapes of slots and jaw members may be used in accordance with the varied protruding members. "Locking" is achieved by first hooking clamp arms 44 around rib 56 and then rotating base member 26 toward side surface 54. This causes positioning arm 40 to "swing" toward front surface 50. This swinging action also causes slot 42 to approach jaw member 40 and slot 42 to approach positioning arrow 58. Upon contact, jaw member 40 can be "snapped" over positioning arrow 58 so that slot 42 engages positioning arrow 58 and bracket 24 is "snapped" into a friction fit position on gas control valve 48.

Stabilizer arm 46 helps bracket 24 to stay in its friction fit "snapped" position and maintain the stability of bracket 24 with respect to gas control valve 48 when force is applied to button 22 of igniter 12. This stability is imparted despite the opposite intuitive thought that a stabilizer bar arm applied to the bottom surface of gas control valve 48 would not likely be effective to maintain the bracket in the selected position in situations where downward force is applied onto button 22. This is sharply contrasted to the tab 18 employed in the prior art bracket 14 which engages the top surface of the gas control valve and is effective to counteract downward force applied to the igniter button.

Although our apparatus and methods have been described in connection with specific forms thereof, it will be appreciated that a wide variety of equivalents may be substituted for the specified elements described herein without departing from the spirit and scope of this disclosure as described in the appended claims.

What is claimed is:

1. A water heater gas combustion controller comprising:
a gas control valve;
an igniter connected to the gas control valve; and
a bracket adapted to be mounted to the gas control valve comprising:
a base member sized and shaped to be mounted adjacent at least a portion of a first surface of the gas control valve;
an igniter holder extending from the base member in a direction away from the gas control valve and having an opening to receive the igniter;
at least one positioning arm extending from the base member in a direction substantially opposite of the igniter holder and having a slot that engages a body extending outwardly from the gas control valve; and
at least one clamp member extending from the base member in a direction substantially opposite of the igniter holder and adapted to engage at least a portion of a second surface of the gas control valve or a body member extending from the second surface.

2. The controller of claim 1, wherein, the igniter holder is a tab with an opening sized and shaped to receive and hold the igniter in a selected position.

3. The controller of claim 2, wherein the tab extends substantially perpendicularly from the base member.

4. The controller of claim 2, wherein the opening further comprises a pair of slots that receive a pair of clips of the igniter.

5. The controller of claim 1, wherein the base member is substantially flat, and lies along side the first surface.

6. The controller of claim 5, wherein the first surface is a side wall of the gas control valve.

7. The controller of claim 1, wherein the arm extends substantially perpendicularly from the base member.

8. The controller of claim 7, wherein the body extends from a front wall of the gas control valve.

9. The controller of claim 1, wherein the clamp member first extends substantially parallel to the base member and then extends toward the second surface.

10. The controller of claim 9, wherein the clamp member is substantially U-shaped and engages a rib formed in the second surface.

11. The controller of claim 1, wherein the clamp member is a pair of U-shaped members and engages a rib formed in the second surface.

12. The controller of claim 1, further comprising a stabilizer arm extending from the base member in a direction substantially opposite of the igniter holder and adapted to engage at least a portion of a surface of the gas control valve.

13. The controller of claim 12, wherein the stabilizer arm is a tab extending substantially perpendicularly from the base member and engages the third surface.

14. The controller of claim 12, wherein the third surface is the bottom of the gas control valve.

15. The controller of claim 1, further comprising a jaw member that engages a valve set point marker extending from the gas control valve.

16. A water heater gas combustion controller comprising:
a gas control valve;
an igniter connected to the gas control valve; and
a bracket adapted to be mounted to the gas control valve comprising:
a base member sized and shaped to be mounted adjacent at least a portion of a first surface of the gas control valve;
an igniter holder extending from the base member in a direction away from the gas control valve and having an opening to receive the igniter, wherein the igniter holder is disposed a first plane;
at least one positioning arm extending from the base member in a direction substantially opposite of the igniter holder and adapted to engage at least a portion of a second surface of the gas control valve or a body extending from the second surface, wherein the positioning arm is disposed in a plane different from the first plane;
at least one clamp member extending from the base member in a direction substantially opposite of the igniter holder and adapted to engage at least a portion of a third surface of the gas control valve or a body member extending from the third surface; and
a stabilizer arm extending from the base member in a direction substantially opposite of the igniter holder and adapted to engage at least a bottom portion of the gas control valve, wherein the stabilizer arm is disposed in a plane different from the first plane.

17. The controller of claim 16, wherein the positioning arm extends substantially perpendicularly from the base member and engages a protrusion on the second surface.

18. The controller of claim 17, wherein the second surface is a front wall of the gas control valve.

19. The controller of claim 16, wherein the stabilizer arm is a tab extending substantially perpendicularly from the base member and engages the fourth surface.

20. The controller of claim 16, further comprising a jaw member that engages a valve set point marker extending from the second surface.

21. The controller of claim 16, wherein the positioning arm is disposed in a plane perpendicular to the first plane.

22. The controller of claim 21, wherein the stabilizer arm is disposed in a plane parallel to the first plane.

23. The controller of claim 16, wherein the stabilizer arm is disposed in a plane parallel to the first plane.

* * * * *